US006009873A

United States Patent [19]

Neviaser

[11] Patent Number: 6,009,873

[45] Date of Patent: Jan. 4, 2000

[54] BED SORE TREATMENT AND PREVENTION METHOD AND APPARATUS

[76] Inventor: Thomas J. Neviaser, 11499 Lakewood La., Fairfax Station, Va. 22039

[21] Appl. No.: 09/140,854

[22] Filed: Aug. 27, 1998

[51] Int. Cl.[7] ..... A61G 15/00

[52] U.S. Cl. ..... 128/845; 128/DIG. 20; 5/630

[58] Field of Search ..... 128/845, 846; 5/630, 465, 632, 655, 657, 922

[56] References Cited

U.S. PATENT DOCUMENTS

| | | | |
|---|---|---|---|
| 2,056,767 | 10/1936 | Blath | 128/132 |
| 2,644,449 | 7/1953 | Champagne | 128/118 |
| 2,724,133 | 11/1955 | Sorrell | 5/630 |
| 3,020,910 | 2/1962 | Ward | 128/132 |
| 3,884,225 | 5/1975 | Witter | 128/133 |
| 3,924,282 | 12/1975 | Bond | 5/632 |
| 4,383,713 | 5/1983 | Roston | 297/219 |
| 4,567,887 | 2/1986 | Couch | 128/132 R |
| 4,780,921 | 11/1988 | Lahn | 5/437 |
| 5,182,828 | 2/1993 | Alivizatos | 5/631 |
| 5,193,238 | 3/1993 | Clute | 5/655 |
| 5,216,772 | 6/1993 | Clute | 5/655 |
| 5,347,669 | 9/1994 | Neviaser et al. | 5/655 |

*Primary Examiner*—Michael A. Brown
*Attorney, Agent, or Firm*—Roberts Abokhair & Mardula, LLC

[57] ABSTRACT

A light weight, inflatable, readily compactible, inexpensive bed sore treatment and prevention method and apparatus. Two inflatable wedges are held in close approximation to a patient/person by a plurality of straps that each encircle the person and the two wedges to a moderate and readily adjustable degree of snugness. Internal partitions help maintain the shapes of the respective wedges. The edges of the wedges can be rounded to optimize comfort for the user. The device is readily portable due to its light weight and its fabrication from flexible, foldable material, which can be plastic, rubber, or any other suitable material that is durable, resilient, and air tight. The wedges are used for a predetermined period of time to maintain the person in one position, after which the person is moved to a different position. The wedges can be used to treat and/or prevent various conditions, such as sleep apnea, snoring, bed sores, etc. The wedges may also be made from foam rubber or the like in which case the inflation is not required.

29 Claims, 5 Drawing Sheets

BED SORE TREATMENT AND PREVENTION METHOD AND APPARATUS

FIELD OF THE INVENTION

The present invention relates generally to body restraint devices used to hold a patient or other person in a selected position on a bed or other support surface. In particular, the present invention relates to an inflatable, light weight, readily compactible, inexpensive body restraint device used to treat and/or prevent bed sores and other wounds or sores, especially for patients who are not readily mobile, or who detrimentally tend to move excessively while resting and sleeping.

BACKGROUND OF THE INVENTION

Bedridden patients who are immobilized for medical cause (e.g., to allow a broken bone to heal) or who are immobile for any reason (e.g., depression, coma, etc.) tend to develop bed sores on body surfaces that are in prolonged contact with bed sheeting or with the covering of any other support surface. Furthermore, the bedridden patient may unconsciously favor resting on body surfaces that have recovering wounds resulting, e.g., from surgery, accident or other trauma. No matter what the cause, when air/oxygen is prevented from reaching the skin of a body part, and when normal perspiration is prevented for a prolonged period, the result is nonoptimal healing and possible infection of an existing wound, or, in the case of no wound at the outset, the formation of bed sores. Thus, whether there is an existing wound at the commencement of bed stay, or bed sores form over time, the possibility of non-healing infections is greatly increased in the bedridden, immobile patient who does not frequently change his position in bed, which, in the extreme, can lead to septicemia and possible death if not quickly diagnosed and properly treated.

A variety of devices have been disclosed for positioning a person. One class of such devices is that of restraining devices to prevent Sudden Infant Death Syndrom (SIDS) in infants. One such device for preventing SIDS is disclosed in U.S. Pat. No. 5,347,669 to Nevaiser, et al., which presents a means for restraining an infant through the use of one smaller and one larger wedge shaped pad, each of which is removably secured to a support member that is placed under the user. A generally vertical face of the smaller wedge shaped pad is placed against the abdomen of the infant, who is on his side, and a generally vertical face of the larger wedge shaped pad is securely positioned against the back of the infant. A belt or strap is used to hold the infant in the desired position between the two wedge shaped pads and upon the support member to which the wedge shaped pads are removably attached. An alternative embodiment employs a diaper-like strapping device that is secured to the infant, with the wedge shaped pads then being removably attached thereto via fastening strips.

U.S. Pat. Nos. 5,193,238 and 5,216,772 to Clute disclose an infant support device for preventing SIDS that utilizes two wedge shaped pillows. A generally vertical face of each wedge shaped pillow is positioned against the stomach or the back of the infant. The distance between the two wedge shaped pillows is controlled largely by positioning fastening strips that are attached to flaps that mutually extend between the bottom surfaces of the two wedges. A belt/strap is used to securely hold the infant within the confines of the support pillow wedges. A ventilation system in the form of a channel in each generally vertical face can be incorporated into each of the two wedge shaped pillows.

Another class of devices includes those used for treating bed sores. One such example is that of U.S. Pat. No. 4,567,887 to Couch, Jr., which discloses a device designed to prevent and treat decubitus ulcerations of bony protuberances of hip, sacral, scapular, and elbow regions of the body. In effect, inflatable pillows of various "doughnut" shapes (round, square, triangular, pentagonal, etc.) are provided as buffers to assume any pressure directed to the general area of a wound or sore, which is protectively contained within the central "hole" of the "doughnut."

U.S. Pat. No. 3,020,910 to Ward discloses an inflatable, curved decubitus pad that consists of two parallel inflated ridges connected by a web therebetween. The curved decubitus pad is positioned such that sacral and hip bony protuberances fall between the two parallel inflated ridges (i.e., within the web area), and a belt holds the pad in proper relation to the user's body.

Yet another class of devices includes those used for general restraint or positioning of a patient or other person. One such example is that of U.S. Pat. No. 4,383,713 to Roston, which discloses an orthopedic support apparatus for supporting the head and body of an infant on its back. Lateral support members for positioning the middle (abdomen and hips) of the infant are removable and multi-positionable to enable a wide range of useable positions. The head and neck portion is contoured to closely match the shape of the head and neck of a "typical" infant.

U.S. Pat. No. 3,884,225 to Witter discloses a device used to turn and hold a patient in position via attachments to the side rails of a bed. The device is a long, flexible muslin sheet with a fleece cushion in the middle, and a flexible strap at each comer extending away from the respective ends of the muslin sheet in a direction parallel to the longest dimension of the muslin sheet. The device is wrapped, along the long dimension, around three sides of a patient, and the ends are pulled to position the patient as desired. Once the patient is in position, the flexible straps are attached about the side rails of the bed. The fleece cushion in the middle provides friction to assist moving the patient, and also to help hold the patient in the desired position at the end of a positioning maneuver.

U.S. Pat. No. 2,644,449 to Champagne discloses a bellows style inflatable pad with straps for securing about a body or body part. This pad is designed to support in variable fashion (according to degree of inflation) a desired body part.

U.S. Pat. No. 2,056,767 to Blath discloses a pad for supporting the back of a patient. Straps about the patient's body hold the pad in place. The pad features a longitudinal slit or opening into which the patient's vertebrae may extend without contacting the mattress or other support surface.

French Patent No. 1,449,012 to Emelien discloses a set of pads whose contours approximate the shape of an infant. One of the two contoured pads is positioned against the abdomen and possibly thighs of the infant, and the second contoured pad is positioned against the back side of the infant. A single belt is then used to securely hold the pads against the infant, and thus maintain the infant in a safe position on his side.

The above described inventions all describe pads/pillows that provide support for one or more body parts, or the entire body, of a patient or other person. What is needed is a support device that not only is versatile as to the manner and direction of support of the body or body part of an immobile or relatively immobile person, but also is of such simple construction as to be very inexpensive, and therefore accessible even to a patient or person of limited means. Furthermore, what is needed is a support device that not only provides variable, adjustable and comfortable support, but also is very flexible and resilient, as well as highly compactible and light in weight for maximum portability.

SUMMARY OF THE INVENTION

It therefore is an object of the present invention to provide an inexpensive, inflatable, wedge shaped support device that is comfortable and easy to use.

It is yet a further object of the present invention to provide an inflatable, wedge shaped support device that is capable of comfortably supporting a person in a side position.

It is another object of the present invention to provide an inflatable, wedge shaped support device that is capable of comfortably supporting a person in a tilted position intermediate between "flat on the back" and on the side.

It is a further object of the present invention to provide an inflatable, wedge shaped support device that is capable of supporting one or more body parts, such as the hips/sacrum area and shoulders or middle back, at a level above the mattress or other support surface on which the person is positioned.

It is yet another object of the present invention to provide an inflatable, wedge shaped support device that is light in weight and highly compactible so as to be optimally portable.

The present invention fulfills the above objectives by providing at least a pair of inflatable, wedge shaped support devices ("wedges") with preferably at least two sets of straps/belts (hereinafter "straps") for positioning and securing the wedges about the person/patient (hereinafter "person") to hold the person in the desired position. In one embodiment, the wedges are of two different sizes, the smaller for positioning against the person's abdomen, and the larger for positioning against the person's back. The shape of a cross section of each wedge at right angles to the longitudinal dimension of a wedge is a triangle, preferably approximately a right triangle, which thereby provides a generally vertical face when the face representing the other side of the right triangle is facing downward. In the preferred embodiment, the remaining two angles each can range from about 25 degrees to about 65 degrees, as long as the sum of the two angles is no more than about 90 degrees. Internal partitions serve to maintain the shape of a wedge. In a preferred embodiment, the internal partitions do not create a series of air tight compartments within a given wedge so that a minimum of only one inflation/deflation valve is required per wedge. Inflation can be by any conventional means, e.g., electric pump, manual pump, foot operated pump, compressed air or gas(es), breathing into a wedge, etc. Deflation can be by any of the aforementioned pumps, or by simple compression, e.g., by pressing with hands, sitting on it, standing on it, etc. The edges of the wedges can be rounded to maximize the person's comfort.

In alternative embodiments, the shape of a cross section at right angles to the longitudinal dimension of a wedge can be any one of a variety of shapes, e.g., in a generally triangular shape with the exception of either or both triangle tips for the two lesser angles being "cut off" to form, respectively, a trapezoidal or a pentagonal shape. Alternatively, the "cut off" sections can be gently rounded, or other shapes can be used to optimize support for specific needs.

The wedges are readily portable due to their light weight, their compactibility, and their fabrication from flexible, foldable material, such as plastic, rubber, or any other similarly suitable material that is durable, resilient, and air tight.

In one embodiment, a generally vertical face of a smaller wedge is positioned against the abdomen of the person, a generally vertical face of a larger wedge is positioned against the back of the person, and the two sets of straps are attached to provide the requisite degree of tightness.

In a second embodiment, the hypotenuse faces of two wedges (which can be of the same or different sizes, depending on the particular application) can be positioned under a portion of the person to raise a selected body area off the bed or other support surface. For example, this embodiment can be used to raise the hip/sacrum area off the bed to effectuate healing of a wound or sore that otherwise would be kept in constant apposition to the bed and bedding. The straps are adjusted to provide the requisite separation of the wedges. Alternatively, other body areas can be so raised, e.g., lower back, middle back, upper back, neck, head, thigh, etc. This embodiment optimally requires the use of a range of sizes of wedges according to the specific area to be raised, including consideration as to the size/weight of the body part or area.

In a third embodiment, a plurality of sets of wedges can be used, as in the above described third embodiment, to support multiple body parts/areas. For example, if hips, middle back and shoulders required simultaneous support, a minimum of three sets of inflatable wedges would be required. The entire body can even be so supported.

In a fourth embodiment, one or more sets of wedges can be used to position a person to help control any of various medical problems, e.g., sleep apnea, snoring, etc., or generally to promote better healing of a wound or injury.

For the person whose objective is to avoid bed sores, the first two above embodiments can be modified to include rotation of the person from one side to the other side after the lapse of a predetermined period of time, and then back to the first side following the predetermined period of time. With respect to the above third through fifth embodiments, the wedges can be moved to greater or lesser degree after a predetermined period of time so as to prevent bed sores or other sores in the body areas in contact with the wedges.

BRIEF DESCRIPTION OF THE DRAWINGS

FIG. 6-A shows a single truncated wedge to produce a trapezoid.

FIG. 6-B shows a double truncated wedge to produce a pentagon.

FIG. 6-C presents a variation on the FIG. 6-B pentagon which incorporates curved connections between the hypotenuse and the other two sides.

FIG. 6-D shows a complex shape that is designed with a horizontal support section.

DESCRIPTION OF THE PREFERRED EMBODIMENTS

As noted earlier, the present invention comprises a series of triangular cross section pillows, which may be made from foam rubber or may be inflatable. Straps connect the triangular cross section pillows so that they may be configured and adjusted in the manner described in detail below.

Figure 1:
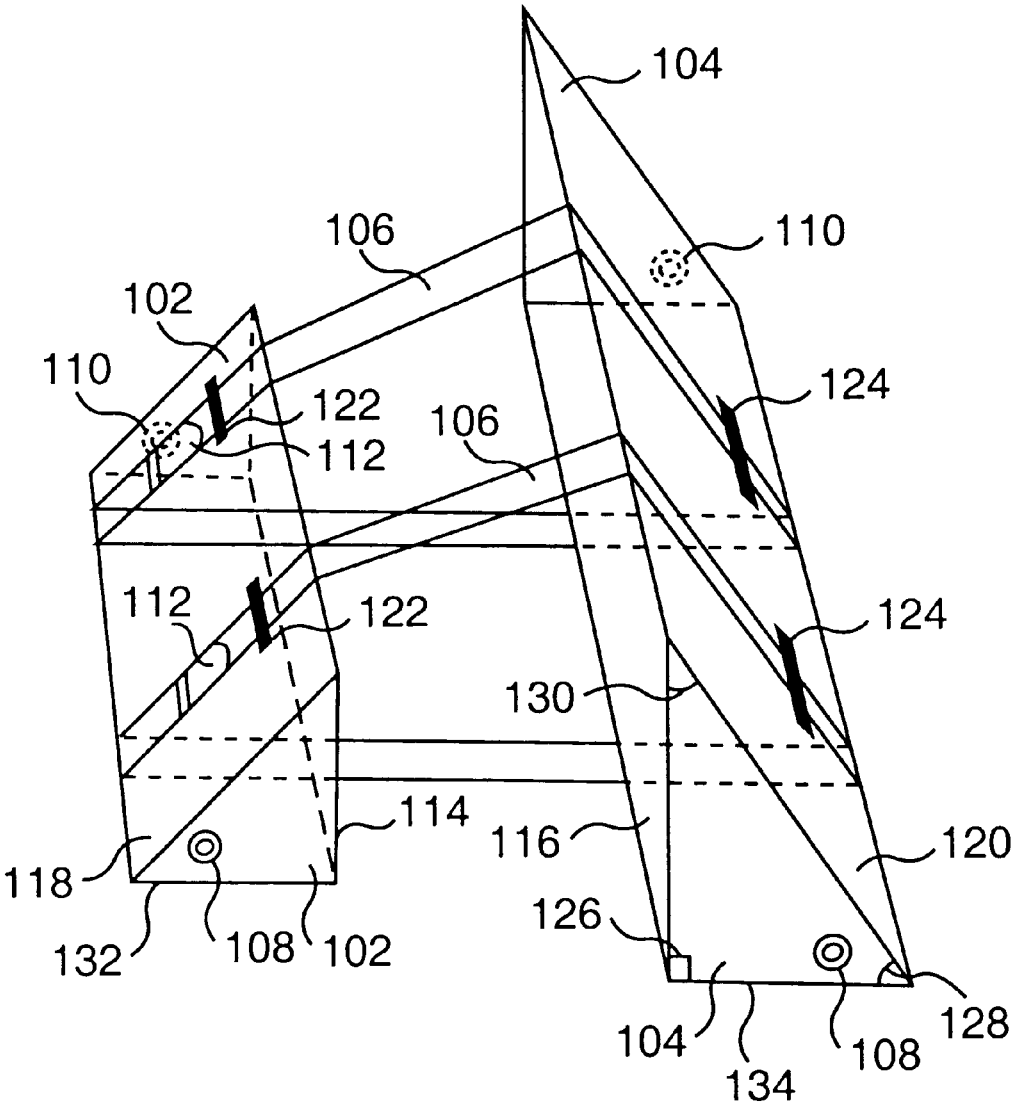
FIG. 1 shows a perspective view of the bed sore treatment and prevention apparatus.

Referring to FIG. 1, the support apparatus of the present invention comprises a smaller inflatable wedge 102, a larger inflatable wedge 104, and straps 106, which pass through and are held in place by loops 122 and 124. Loops 122 and 124 create the desired paths of straps 106 to include paths on hypotenuse intermediate faces 118 and 120, as well as horizontal intermediate faces 132 and 134, and vertical intermediate faces 114 and 116. Furthermore, straps 106 each have fastening means 112, such as a belt buckle, a hole-and-prong fastener, single or multiple loops, pressure fasteners, hook and loop, knot, or any other convenient means to fasten the two ends of a strap. In addition, each inflatable wedge has at least one inflation/deflation valve 108, and can optionally have an additional one or more inflation/deflation valves 110. The edges of each wedge can be rounded to provide smooth, continuous surfaces that will not cut or otherwise scratch or irritate the skin of the user. The material of each wedge is any strong, flexible, nonirritating, resilient, light weight, air-tight material or fabric, including any of a wide range of plastics and rubbers, or combinations thereof, and can comprise more than one layer. In order to provide maximum portability, the material of each wedge is sufficiently flexible and foldable to allow the wedge to be readily compactible for storage and transport at the smallest compacted volume possible. The straps can be of the same or a similar material as the material of the wedges, or they can be of woven fabric that need not be air tight. An inflation/deflation means (not shown) can be provided, including electrical pump, hand or foot powered pump, compressed air or gas(es), "blowing in" by an individual, or any other suitable means or pump.

The vertical intermediate faces 114 and 116, as well as hypotenuse intermediate faces 118 and 120 of the respective wedges, potentially contact a user. Horizontal intermediate faces 132 and 134 can also be used for support or other contact with a user or a body part of a user. Angles of the faces one to another can vary according to the intended use(s). Typically, upon inflation, angle 126 is about 90 degrees, and angles 128 and 130 can range from about 25 degrees to about 65 degrees, though angles outside these ranges are also contemplated. If angle 126 is about 90 degrees, then the sum of angles 128 and 130 is about 90 degrees. When angle 126 is about 90 degrees, the horizontal and vertical faces will be interchangeable according to which face is positioned downward.

Figure 2:
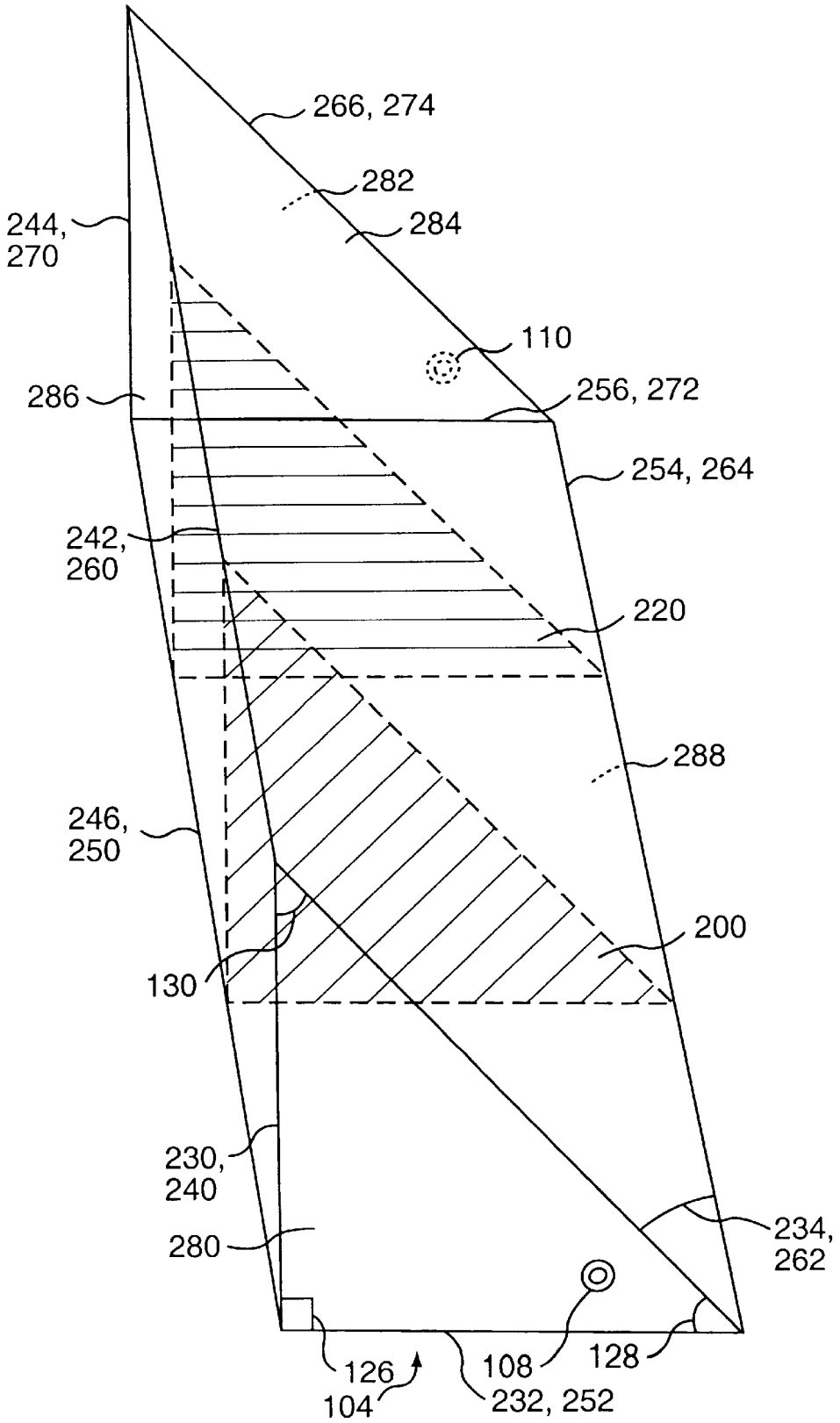
FIG. 2 shows a perspective cut away view of a wedge of the bed sore treatment and prevention apparatus, including interior partitions.

Referring to FIG. 2, a cut away view shows interior partitions 200 and 220, which help hold the shape of a wedge when inflated and in use. The material of the interior partitions can be similar to that of the wedge, but the material need not be air tight. The interior partitions are attached to the inner surfaces of the material of the wedge by any suitable means, including glue, hot welding, sewing, etc. When a single inflation/deflation valve is used, as in the preferred embodiment, the seams therefore or the material of the interior partitions are not air tight. The interior partitions and their seams with the interior surfaces of the wedge material, as well as any seams with other interior partitions, are sufficiently flexible to permit a wedge that is readily compactible for optimal portability. The interior partitions can vary in number from one to about twenty, though the preferable range is from two to about eight in the larger inflatable wedges, and from one to about 5 in the smaller inflatable wedges. In a preferred embodiment, the interior partitions are generally at right angles to the longest axis that is parallel to the longest faces of the wedge; however, interior partitions that run parallel to the same longest axis are also contemplated in optional embodiments. The number and the positions of interior partitions can be varied according to the need therefore, for example, a larger wedge or a larger and heavier user can dictate the use of more interior partitions and/or the use of additional interior partitions that are positioned at right angles to the usual interior partitions.

Referring again to FIG. 2, larger inflatable wedge 104 is shown to comprise five faces: first triangular end face 280 located at the first end of the larger inflatable wedge, second triangular end face 282 located at the second end of the larger inflatable wedge, vertical intermediate (rectangular) face 286, horizontal intermediate (rectangular) face 288, and hypotenuse intermediate (rectangular) face 284. Where edges of faces meet, common edges are defined. Thus, first triangular vertical edge 230 of first triangular end face is common with first vertical intermediate short edge 240 of vertical intermediate face 286; first triangular horizontal edge 232 of first triangular end face 280 is common with first horizontal intermediate short edge 252 of horizontal intermediate face 288; first triangular hypotenuse edge 234 of first triangular end face is common with first hypotenuse intermediate short edge 262 of hypotenuse intermediate face 284; second triangular vertical edge 270 of second triangular end face 282 is common with second vertical intermediate short edge 244 of vertical intermediate face 286; second triangular horizontal edge 272 of second triangular end face 282 is common with second horizontal intermediate short edge 256 of horizontal intermediate face 288; second triangular hypotenuse edge 274 is common with second hypotenuse intermediate edge 266 of hypotenuse intermediate face 284; top vertical intermediate long edge 242 is common with top hypotenuse intermediate long edge 260 of hypotenuse intermediate face 284; bottom vertical intermediate long edge 246 is common with lefi horizontal intermediate edge 250 or horizontal intermediate face 288; and lower hypotenuse intermediate edge 264 of hypotenuse intermediate face 284 is common with right horizontal intermediate long edge of horizontal intermediate face 288. Furthermore, at least one intermediate face corresponds with each edge of an end face.

Figure 3:
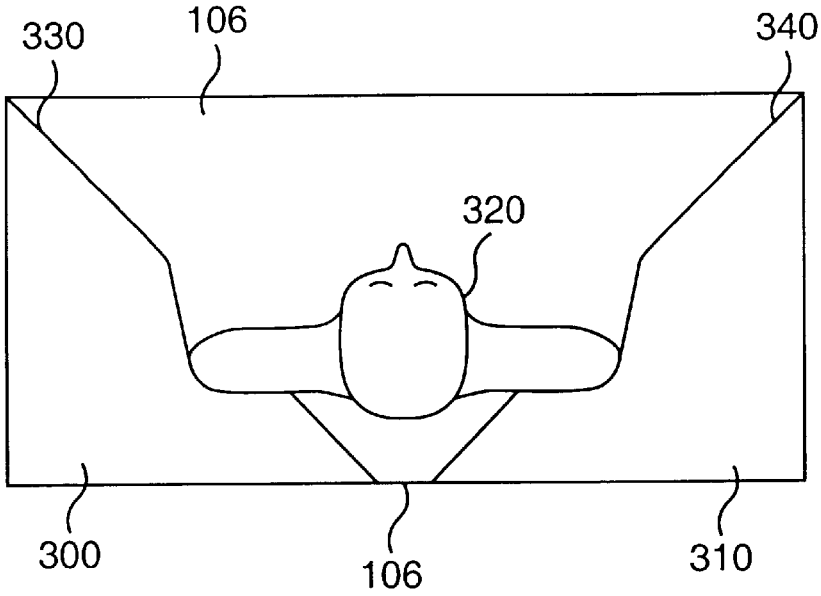
FIG. 3 shows an end-on view of the bed sore treatment and prevention apparatus in application to raise a body or a body part off of a mattress.

Referring to FIG. 3, a pair of inflatable wedges 300 and 310 is used to suspend patient/person 320 or a part of the body of a person above the mattress or other support surface. The person or the person's body part are positioned upon respective hypotenuse intermediate faces 330 and 340 of the wedges. Straps 106 are adjusted to maintain the desired separation between the respective wedges. Such an arrangement facilitates the healing of a bed sore or wound by permitting air circulation to the pertinent area.

Figure 4:
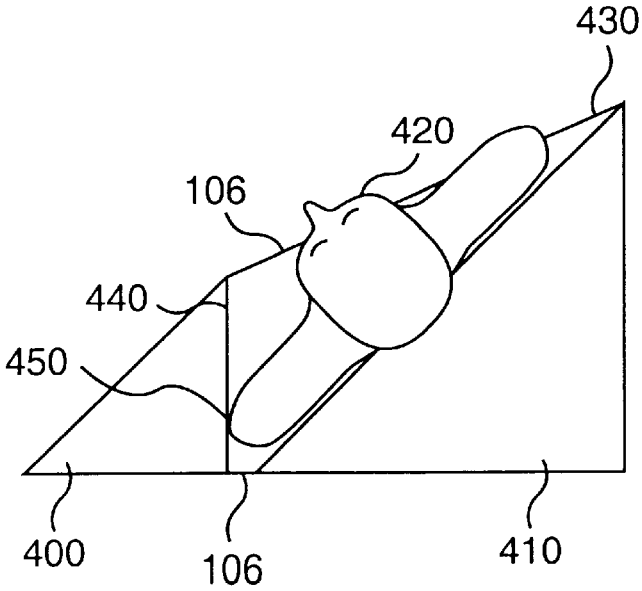
FIG. 4 shows an end-on view of the bed sore treatment and prevention apparatus in application to hold a body laterally at an angle relative to the plane of a mattress.

Referring to FIG. 4, an embodiment is shown in which the person's body 420 is positioned at an angle upon hypotenuse intermediate face 430 of inflated wedge 410. Smaller inflated wedge 400, by supplying pressure from its vertical intermediate face 440 against left shoulder 450 of the person, helps hold the person's body in the desired position. Straps 106 maintain the proper spacing between the two wedges.

Figure 5:
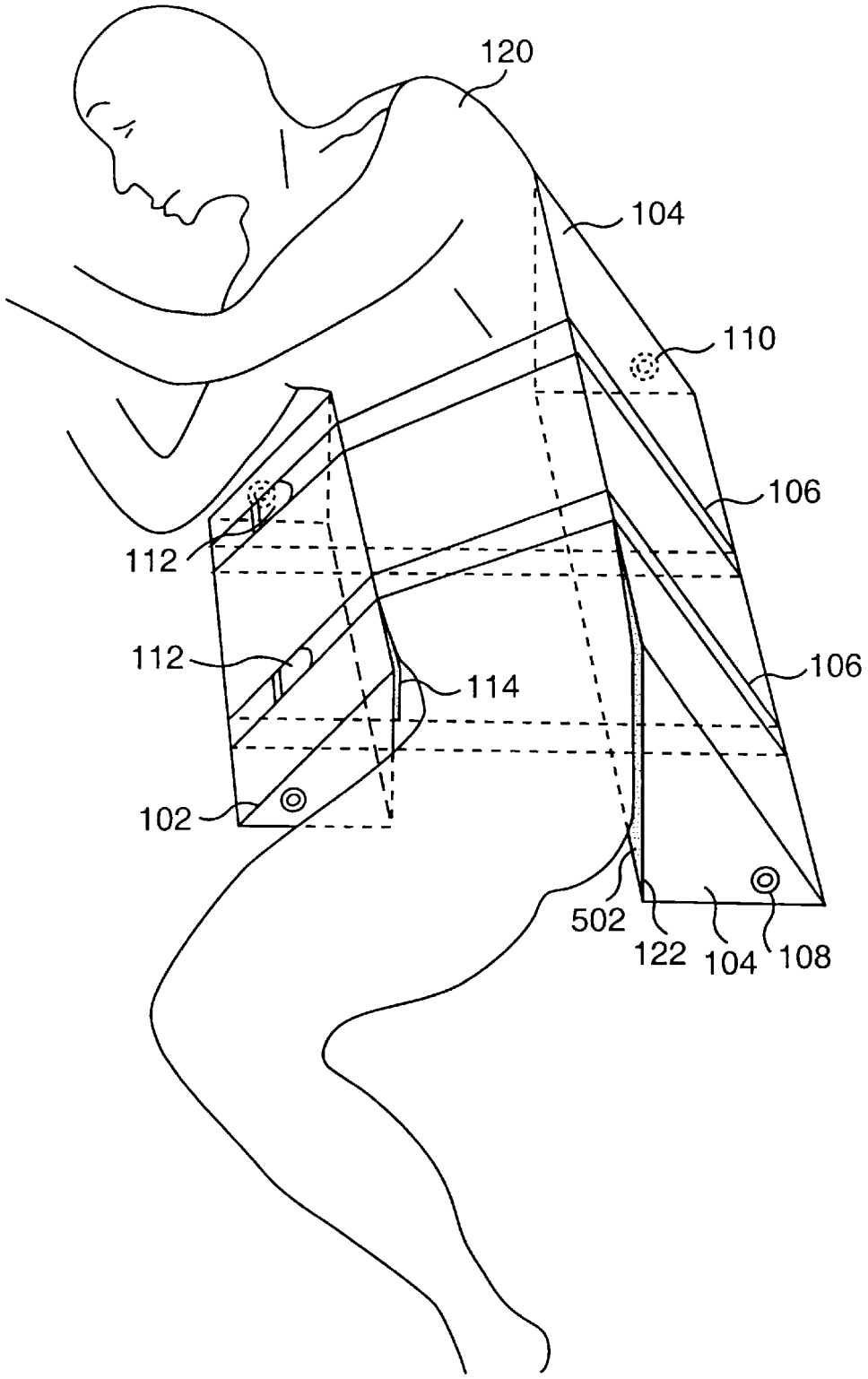
FIG. 5 shows a perspective view of the bed sore treatment and prevention apparatus in application to hold a body on its right side.
Figure 6A:
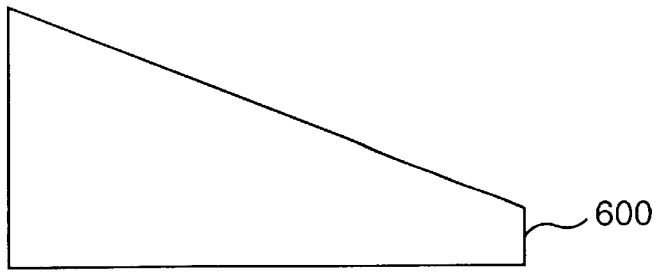
FIGS. 6-A through 6-D present cross sectional views of alternative embodiments of the bed sore treatment and prevention apparatus of the present invention.
Figure 6B:
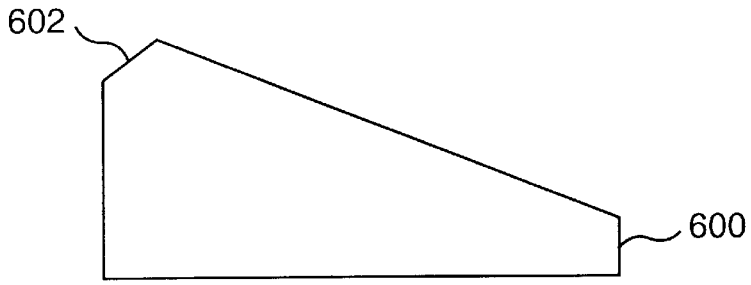
Figure 6C:
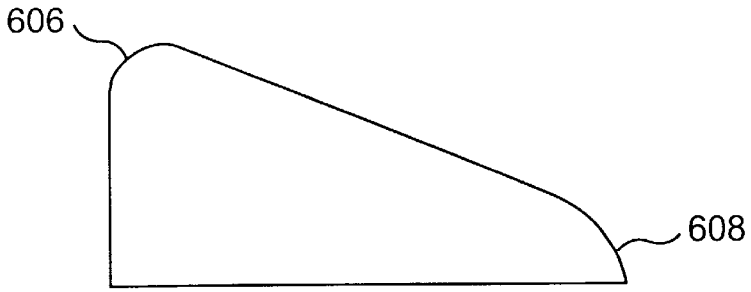
Figure 6D:
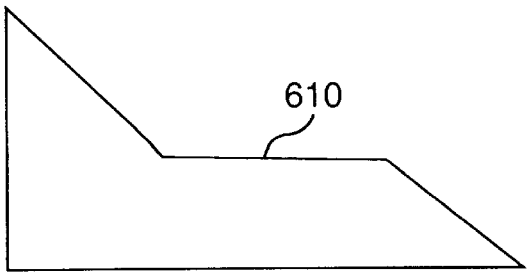

Referring to FIG. 5, an embodiment is shown in which vertical face 114 of smaller wedge 102 is positioned against the person's abdomen, and vertical face 116 of larger wedge 104 is positioned against the person's back. Such use properly maintains person 120 on his right side. After a predetermined period of time, the person is rotated and the wedges are positioned to similarly hold the person on his left side to allow air circulation to the person's left side. By so alternating the person from side to side with an appropriate time schedule, bed sores are prevented. In the event of the presence of bed sores prior to the practicing of this invention, such a schedule of alternating positions for the person, combined with use of wedges of the present invention, will facilitate the healing of a bed sore or other wound by permitting air circulation to all sides of the person. The predetermined periods of time over which the person is held on one side before repositioning on the other side will vary according to the medical situation, and typically will range between 20 minutes and 3 hours. However, longer periods, for example, 6 hours, are also contemplated.

In addition, alternative embodiments can also include exterior lining 502 for those portions of the wedge which come into contact with the user. In a preferred embodiment this lining is made of a soft absorbed matter such as, for example, lambs wool or any other synthetic or natural absorbent, hypo-allergenic material.

Referring to FIGS. 6-A through 6-D, a variety of alternate cross sectional shapes are shown for the inflated wedge of the present invention. In FIG. 6-A a wedge is shown with the smaller acute angle truncated by flat face 600.

Referring to FIG. 6-B, a wedge is shown with double truncation in which the larger acute angle is truncated by flat intermediate face 602, in addition to truncation of the smaller acute angle by flat intermediate face 600.

Referring to FIG. 6-C, a variant of the wedge of FIG. 6-B is shown in which flat intermediate faces 600 and 602 are respectively replaced by curvilinear intermediate faces 608 and 606.

Referring to FIG. 6-D, a wedge is shown in which flat horizontal intermediate face 610 is featured for supporting a body part, including for use in combination with a second wedge in the manner depicted in FIG. 3.

Alternative embodiments also include the use of multiple pairs of inflatable wedges, for example, for use to support extended portions of a body, including the whole length of a body. Such use is important in complex trauma cases, as well as in cases in which body position during sleeping is important, for example, in persons who exhibit sleep apnea and/or excessively loud snoring when sleeping. Additionally, and as noted earlier, the wedges may also be made from foam rubber, latex rubber or other such suitable material in which case inflation is not a key element.

Furthermore, it is foreseen that the apparatus and method of the present invention will also be useful in the veterinary field for positioning animals and the like.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, but are not expressly stated herein. These modifications, alterations and improvements are intended to be suggested hereby, and within the scope of the invention. Accordingly, the invention is limited only by the following claims and equivalents thereto.

What is claimed is:

1. A bed sore treatment and prevention apparatus comprising a set of two inflatable wedges, wherein each inflatable wedge comprises:

a first end face located at a first end of the inflatable wedge, comprising at least three first end edges;

a second end face located at a second end of the inflatable wedge, comprising at least three second end edges; and at least three intermediate faces, where:

each intermediate face is located between the first end face and the second end face;

each intermediate face has an intermediate first edge located at the first end of the inflatable wedge;

each intermediate face has an intermediate second edge located at the second end of the inflatable wedge;

each intermediate first edge is attached to one of the at least three first end edges of the first end face, creating a first area of attachment;

each intermediate second edge is attached to one of the at least three second end edges of the second end face, creating a second area of attachment; and each intermediate face is attached to the intermediate face adjacent thereto, creating a third area of attachment; and where:

the wedges are used for maintaining a person in a position.

2. The bed sore treatment and prevention apparatus of claim 1, where each inflatable wedge further comprises an inflation/deflation valve for inflating and deflating the inflatable wedge.

3. The bed sore treatment and prevention apparatus of claim 2, where each inflatable wedge further comprises a plurality of inflation/deflation valves.

4. The bed sore treatment and prevention apparatus of claim 1, where each of the intermediate faces and the first and second end faces is made of an air tight material.

5. The bed sore treatment and prevention apparatus of claim 4, where the air tight material is selected from the group consisting of plastic, multiple layered plastic, rubber, multiple layered rubber, coated fabric, and combinations thereof.

6. The bed sore treatment and prevention apparatus of claim 1, further comprising:

a plurality of loops affixed on each intermediate face, where each loop maintains the position of a strap therethrough; and a plurality of straps, where each strap has a first end and a second end.

7. The bed sore treatment and prevention apparatus of claim 6, where the straps further comprise a fastening means for connecting the first end of the strap to the second end of the strap.

8. The bed sore treatment and prevention apparatus of claim 7, where the fastening means is selected from the group consisting of buckle, hook and loop, knot, and prong and hole.

9. The bed sore treatment and prevention apparatus of claim 1, where there is at least one interior partition within each inflatable wedge for helping to maintain the shape of the inflatable wedge when inflated.

10. The bed sore treatment and prevention apparatus of claim 9, where the interior partitions are readily compactible and foldable upon full deflation to enhance portability.

11. The bed sore treatment and prevention apparatus of claim 1, where the inflatable wedges are readily compactible and foldable upon full deflation to enhance portability.

12. The bed sore treatment and prevention apparatus of claim 1, where:

the end faces are triangular, and have edges that form first, second, and third angles; and where upon inflation, the first angle is about 90 degrees.

13. The bed sore treatment and prevention apparatus of claim 12, where, upon inflation, the second and third angles range from about 25 degrees to about 65 degrees.

14. The bed sore treatment and prevention apparatus of claim 12, where, upon inflation, one of the second and third angles is less than 25 degrees.

15. The bed sore treatment and prevention apparatus of claim 12, where, upon inflation, the first angle is greater than 90 degrees.

16. The bed sore treatment and prevention apparatus of claim 12, where, upon inflation, the first angle is less than 90 degrees.

17. The bed sore treatment and prevention apparatus of claim 1, where the edges formed by areas of attachment are rounded to improve comfort to the person using the inflatable wedges.

18. The bed sore treatment and prevention apparatus of claim 1, where:

the two end faces each have more than three edges, the two end faces are the same size and shape; and there is at least one intermediate face corresponding to each edge of the end faces.

19. The bed sore treatment and prevention apparatus of claim 1, where an exterior lining comprising an absorbent material is affixed to at least one of the three intermediate faces.

20. A method for maintaining the position of a person by restraining the person with a smaller inflatable wedge, a larger inflatable wedge, and a plurality of straps, comprising:

positioning the person on a first side;

positioning the smaller inflatable wedge against the person's abdomen;

positioning the larger inflatable wedge against the person's back;

positioning each of the straps around the two inflatable wedges and the person; and tightening and fastening each of the straps.

21. The method for maintaining the position of a person as in claim 20, where:

each wedge has one intermediate face that is oriented vertically, comprising:

positioning the vertically oriented intermediate face of the smaller wedge is positioned against the person's abdomen; and positioning the vertically oriented intermediate face of the larger wedge against the person's back.

22. The method for maintaining the position of a person as in claim 20, where:

the two inflatable wedges are of similar sizes and shapes; and each wedge has one hypotenuse intermediate face, comprising:

positioning the vertically oriented intermediate faces of the two wedges away from the person; and positioning the hypotenuse intermediate face of each wedge beneath the person to raise the person off of a support surface to permit air to circulate to beneath the person.

23. The method for maintaining the position of a person as in claim 20, where:

the two inflatable wedges are of similar sizes and shapes; and each wedge has one hypotenuse intermediate face, comprising:

positioning the vertically oriented intermediate faces of the two wedges away from a body part to be supported; and positioning the hypotenuse intermediate face of each wedge beneath the body part to raise the body part of the person off of a support surface to permit air to circulate beneath the body part.

24. The method for maintaining the position of a person as in claim 20, further comprising:

waiting a predetermined period of time;

positioning the person on a different side;

positioning the smaller inflatable wedge against the person's abdomen;

positioning the larger inflatable wedge against the person's back;

positioning each of the straps around the two inflatable wedges and the person; and tightening and fastening each of the straps.

25. A bed sore treatment and prevention apparatus comprising:

a set of at least two support pieces wherein each piece comprises, a substantially wedge shape having at least three faces wherein the faces are in relationship of having one angle at about 90 degrees;

means for inflating the wedges when in use and means for deflating the wedges for storage;

at least two adjustable straps to hold the wedges in position relative to each other and to a human body; and means for holding the straps in position relative to the wedges, wherein said means allow the utilization of any face of the wedge against a human body.

26. The apparatus of claim 25 wherein one wedge is smaller than the other wedge.

27. The apparatus of claim 25 wherein the at least three faces are in relationship of having one angle at about 90 degrees and wherein other angles are not equal.

28. The apparatus of claim 25 wherein the at least two wedges are of sufficient length and width to be utilized underneath a human body to elevate the body above a support structure.

29. The apparatus of claim 25 wherein the straps include means for adjusting the position of the wedges relative to each other.

* * * * *